US012742443B1

(12) United States Patent
Ahmed et al.

(10) Patent No.: US 12,742,443 B1
(45) Date of Patent: Sep. 22, 2026

(54) APPARATUS FOR DELIVERING METERED FLUID AT ELEVATED PRESSURE

(71) Applicant: PRINCE SATTAM BIN ABDULAZIZ UNIVERSITY, Al-Kharj (SA)

(72) Inventors: Mohamed Mohamed Zaky Ahmed, Al-Kharj (SA); Mohamed Elashmawy, Salam City (EG)

(73) Assignee: PRINCE SATTAM BIN ABDULAZIZ UNIVERSITY, Al-Kharj (SA)

( * ) Notice: Subject to any disclaimer, the term of this patent is extended or adjusted under 35 U.S.C. 154(b) by 0 days.

(21) Appl. No.: 19/371,471

(22) Filed: Oct. 28, 2025

(51) Int. Cl.

| | |
|---|---|
| ***F04B 13/00*** | (2006.01) |
| ***F04B 23/02*** | (2006.01) |
| ***F04B 23/10*** | (2006.01) |
| ***F04B 23/14*** | (2006.01) |
| ***F04B 49/06*** | (2006.01) |
| ***F04B 53/10*** | (2006.01) |

(52) U.S. Cl.
CPC ..... *F04B 13/00* (2013.01); *F04B 23/02* (2013.01); *F04B 23/106* (2013.01); *F04B 23/14* (2013.01); *F04B 49/06* (2013.01); *F04B 53/10* (2013.01); *F04B 2205/064* (2013.01)

(58) Field of Classification Search
CPC ..... F04B 13/00; F04B 23/02; F04B 23/106; F04B 23/14; F04B 49/06; F04B 53/10; F04B 2205/064
See application file for complete search history.

(56) References Cited

U.S. PATENT DOCUMENTS 3,849,027 A * 11/1974 Blake ..... F04B 49/20 417/223
4,029,440 A * 6/1977 Olsen ..... H01F 38/02 91/305
4,368,008 A * 1/1983 Budzich ..... F04B 9/115 417/267
4,373,865 A * 2/1983 Budzich ..... F04B 9/115 417/403
4,844,700 A * 7/1989 Henderson ..... F04B 9/1073 417/225

(Continued)

FOREIGN PATENT DOCUMENTS

CN 106460743 A * 2/2017 ..... F04B 53/10
WO WO 93/24238 A1 12/1993

OTHER PUBLICATIONS

Translation of cn-106460743 (Year: 2026).*

*Primary Examiner* — William M McCalister
(74) *Attorney, Agent, or Firm* — Oblon, McClelland, Maier & Neustadt, L.L.P.

(57) ABSTRACT

An apparatus for delivering fluid at elevated pressure includes a pressure vessel to store pressurized air and a liquid, a piston assembly including a first piston movable within a first cylinder and a second piston movable within a second cylinder. The first piston and the second piston are connected through a common shaft. A control valve to selectively connect the pressure vessel or a liquid reservoir to the first cylinder. A delivery check valve and a suction check valve connected to the second cylinder to control fluid flow during operation. The apparatus operates in a repeating cycle including a delivery mode and a suction mode.

20 Claims, 9 Drawing Sheets

(56) References Cited

U.S. PATENT DOCUMENTS

| | | | | |
|---|---|---|---|---|
| 6,357,235 | B1 * | 3/2002 | Cerro | F04B 9/105 60/645 |
| 7,686,596 | B2 * | 3/2010 | Clausen | F15B 3/00 60/560 |
| 9,291,161 | B2 * | 3/2016 | Hogan | F04B 49/22 |
| 10,208,737 | B1 * | 2/2019 | Freeman | F04B 9/105 |
| 11,401,792 | B2 * | 8/2022 | Mollatt | F04B 9/00 |
| 11,815,078 | B2 * | 11/2023 | Schubart | F04B 27/0673 |
| 11,829,165 | B2 * | 11/2023 | Iversen | F02M 37/04 |
| 2003/0118459 | A1 * | 6/2003 | Gerhardt | F04B 49/065 417/390 |
| 2004/0079416 | A1 * | 4/2004 | Linne | G05D 7/0635 137/487.5 |
| 2005/0056320 | A1 * | 3/2005 | Gruett | G05D 7/014 137/506 |
| 2011/0176940 | A1 * | 7/2011 | Ellis | A61B 17/3203 417/399 |
| 2018/0135606 | A1 * | 5/2018 | Oklejas, Jr. | F04F 13/00 |

* cited by examiner

APPARATUS FOR DELIVERING METERED FLUID AT ELEVATED PRESSURE

BACKGROUND

Technical Field

The present disclosure relates to fluid metering systems. More particularly, the present disclosure pertains to an apparatus for delivering fluid at elevated pressure with controlled metering for improved accuracy and performance.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Metering pumps are widely used in industrial applications for delivering a precise amount of fluid at controlled rates and pressures. Conventional diaphragm metering pumps are widely used due to their simplicity, cost-effectiveness, and reliable dosing capabilities driven by electromagnetic actuators. The diaphragm metering pumps utilize a flexible diaphragm to displace fluid. However, during continuous operation, the diaphragm metering pump is subjected to cyclic mechanical stress leading to fatigue, wear, and eventually causing rapid failure of the diaphragm material. This deterioration leads to premature failure of the diaphragm, necessitating frequent maintenance and replacements. Moreover, the flexible diaphragm poses a risk of fluid leakage, thereby increasing operational downtime, maintenance costs, and potential safety hazards due to equipment failure, contamination, or exposure to hazardous substances.

On the contrary, piston metering pumps deliver highly accurate and consistent fluid dosing, particularly in high-pressure applications. The piston metering pumps operate by using a reciprocating piston to displace fluid within a cylinder chamber, offering precise volumetric control. Despite the dosing precision and pressure handling capabilities, the piston metering pumps present several operational limitations. The dynamic seals and packing around the piston are prone to mechanical wear when exposed to corrosive or abrasive fluids, leading to seal degradation and fluid leakage. Moreover, the tight mechanical tolerances required for piston operation for handling fluids containing particulates or slurries causes abrasion, clogging, and reduced operational reliability of the piston metering pumps. The inherent mechanical complexity of piston metering pumps further contributes to elevated maintenance demands, often necessitating servicing, calibration, and troubleshooting.

Several alternative solutions have been developed to address the limitations of conventional metering pumps, such as hydraulically actuated diaphragm pumps and pressure booster systems incorporating advanced materials and improved sealing technologies. While such systems offer enhanced performance in terms of pressure handling and durability, they often introduce increased mechanical complexity, leading to higher manufacturing costs, more frequent maintenance requirements, and reduced ease of integration into the existing systems.

U.S. Pat. No. 6,357,235B1 describes a closed-loop power generation system that elevates the pressure of a working fluid using piston-type pressure elevating devices driven by an actuator assembly. In this system, the working fluid is heated at substantially constant pressure and expanded in a turbine. The fluid is then returned to the pressure-elevating device, allowing the cycle to operate without phase change. The pressure elevation mechanism employs reciprocating pistons linked by a rod and controlled by valves that alternately draw low-pressure fluid into one chamber and discharge elevated-pressure fluid from the other chamber.

U.S. Pat. No. 4,029,440A describes a pressure intensifying apparatus designed to deliver a high-pressure stream of water through a nozzle. The system includes a single working piston with two large-area pressure surfaces connected to two high-pressure pistons with smaller-area pressure surfaces. A control valve alternately directs high-pressure working fluid to opposite sides of the working piston, causing it to reciprocate and drive the high-pressure pistons. The design incorporates a restricted flow passage in the control valve's intermediate position to minimize pressure spikes during valve transitions. Additional configurations include mechanisms for rapid valve shifting using either pressure-responsive valves or flexible actuating cables.

Each of the aforementioned references presents one or more limitations, such as mechanical complexity, inconsistent fluid delivery, and inadequate pressure control. These drawbacks lead to reduced reliability, higher maintenance requirements, and difficulty in achieving accurate metered fluid delivery at elevated pressure. Accordingly, it is one object of the present disclosure to provide an apparatus configured for delivering a metered volume of fluid in a controlled way during each operating cycle, while maintaining the fluid pressure within predetermined limits.

SUMMARY

In an aspect, an apparatus for delivering fluid at elevated pressure is disclosed, comprising a pressure vessel configured to store pressurized air and a liquid, a piston assembly including a first piston movable within a first cylinder and a second piston movable within a second cylinder. The second piston is connected to the first piston through a common shaft. The first piston includes a piston head area larger than the piston head area of the second piston. The apparatus further includes a control valve configured to selectively connect the pressure vessel or a liquid reservoir to the first cylinder, a delivery check valve, and a suction check valve connected to the second cylinder to control the flow of fluid during operation. The apparatus is configured to operate in a repeating cycle including a delivery mode and a suction mode. In the delivery mode, the control valve connects the pressure vessel to the first cylinder to transfer the pressurized liquid to the first cylinder. This connection causes the first piston and the second piston to move in a first direction, thereby delivering fluid from the second cylinder through the delivery check valve at the elevated pressure corresponding to a vessel pressure. The elevated pressure is increased by a ratio of the piston head area of the first piston to the piston head area of the second piston. In the suction mode, the control valve connects the first cylinder to the liquid reservoir. This connection causes the movement of the first piston and the second piston in a second direction opposite to the first direction to refill the second cylinder with the fluid through the suction check valve.

In some embodiments, the apparatus includes a pump operatively connected to the liquid reservoir through a one-way valve to deliver the liquid to the pressure vessel.

In some embodiments, the pump is a centrifugal pump configured to circulate liquid between the liquid reservoir, the pressure vessel, and the first cylinder in a closed loop.

In some embodiments, the apparatus further includes a pressure sensor operatively coupled to the pressure vessel, configured to monitor the pressure inside the pressure vessel.

In some embodiments, the apparatus further includes a controller configured to receive a plurality of signals from the pressure sensor and to control operations of the pump to maintain the pressure inside the pressure vessel within predetermined limits.

In some embodiments, the control valve is a three-way valve actuated according to a timed sequence to switch the apparatus between the delivery mode and the suction mode.

In some embodiments, the delivery check valve is a one-way valve to permit flow of the fluid from the second cylinder to a delivery conduit during the delivery mode.

In some embodiments, the suction check valve is a one-way valve to permit flow of the fluid from a fluid reservoir into the second cylinder during the suction mode.

In some embodiments, the apparatus further includes an adjustable stroke stopper associated with the piston assembly. The adjustable stroke stopper is configured to limit a range of movement of the first piston and the second piston to control the metered volume of fluid, delivered during each cycle.

In some embodiments, the adjustable stroke stopper includes an adjustable stop member and a threaded control screw.

In some embodiments, the apparatus further includes a return biasing member coupled to the first piston and the second piston. The return biasing member is configured to allow movement of the first piston and the second piston in the second direction toward respective starting positions or within the range defined by the adjustable stroke stopper during the suction mode.

In some embodiments, the return biasing member is a spring.

In another exemplary embodiment, a method for delivering fluid at elevated pressure using an apparatus is disclosed. The method includes storing pressurized air and a liquid in a pressure vessel. The method further includes providing a piston assembly including a first piston movable within a first cylinder and a second piston movable within a second cylinder. The second piston and the first piston are connected through a common shaft. The first piston includes a piston head area larger than the piston head area of the second piston.

In some embodiments, the method includes selectively operating a control valve to connect the pressure vessel to the first cylinder in a delivery mode. In response to the connection, the pressurized liquid is transferred to the first cylinder, causing the first piston and the second piston to move in a first direction. Movement of the pistons in the first direction results in delivering the fluid from the second cylinder through a delivery check valve at a delivery pressure increased by a ratio of the effective areas of the first piston and the second piston.

In some embodiments, the method includes selectively operating the control valve to connect the first cylinder to a liquid reservoir in a suction mode, allowing movement of the first piston and the second piston in a second direction opposite to the first direction, and facilitating refilling of the second cylinder with the fluid through a suction check valve.

In some embodiments, the method includes pumping the liquid from the liquid reservoir to the pressure vessel using a pump through a one-way valve.

In some embodiments, the method further includes pumping the liquid using the pump, such as a centrifugal pump, to facilitate circulation of the liquid in a closed loop between the liquid reservoir, the pressure vessel, and the first cylinder.

In some embodiments, the method includes monitoring the pressure inside the pressure vessel using a pressure sensor.

In some embodiments, the method includes controlling the operation of the pump using a controller based on the pressure monitored using the pressure sensor to maintain the pressure inside the pressure vessel within predetermined limits.

In some embodiments, the method further includes operating the control valve by actuating a three-way valve according to a timed sequence, thereby enabling switching between the delivery mode and the suction mode.

In some embodiments, the method includes adjusting an adjustable stroke stopper associated with the piston assembly to limit the range of movement of the first piston and the second piston to control the delivery of a metered volume of the fluid during each cycle.

In some embodiments, the method further includes moving the first piston and the second piston in the second direction during the suction mode, the movement is facilitated by a return biasing member coupled to the first piston and the second piston.

The foregoing general description of the illustrative embodiments and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
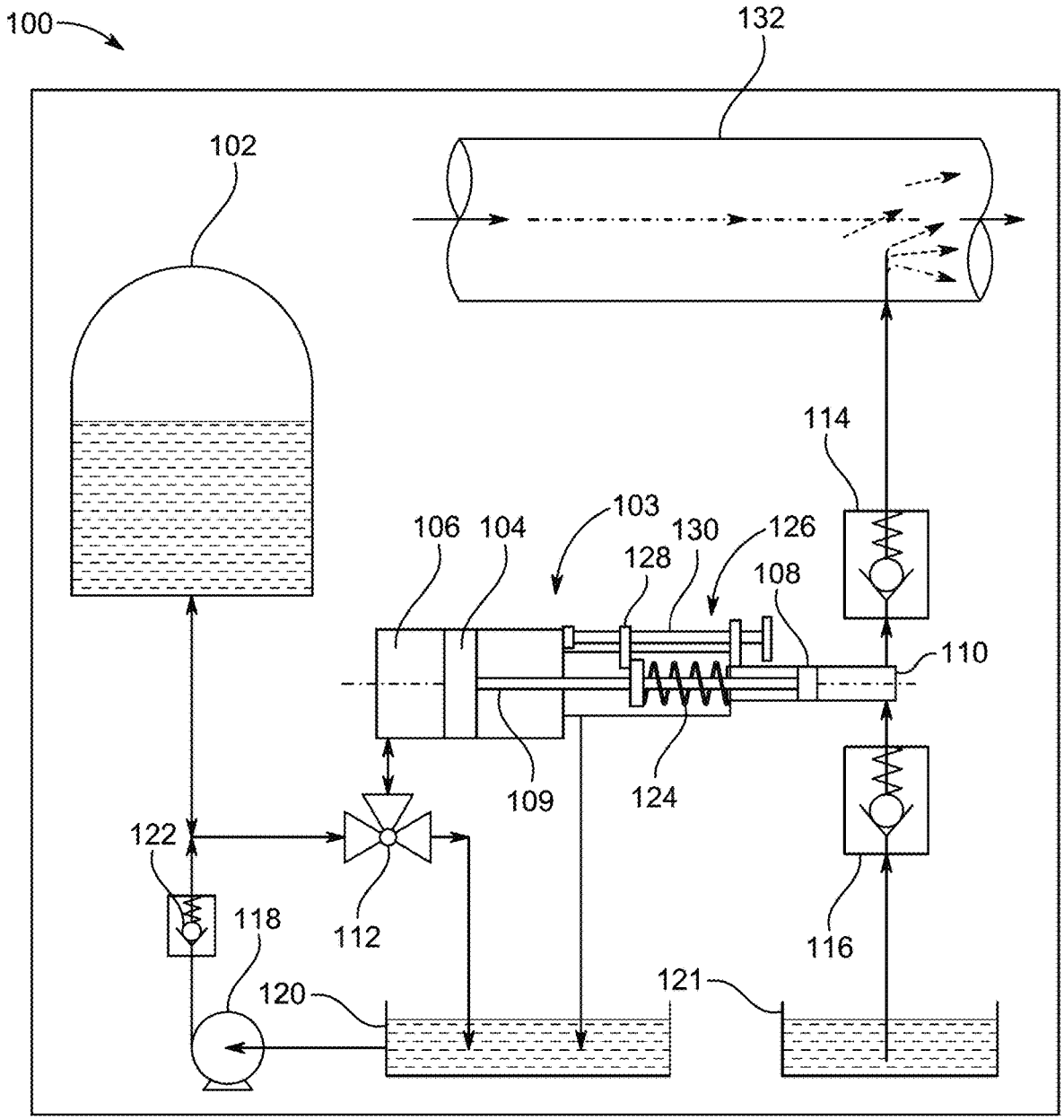
FIG. 1 is a schematic hydraulic circuit diagram of an apparatus for delivering fluid at elevated pressure, according to certain embodiments.

In the drawings, like reference numerals designate identical or corresponding parts throughout the several views. Further, as used herein, the words "a", "an" and the like generally carry a meaning of "one or more", unless stated otherwise.

Furthermore, the terms "approximately," "approximate", "about" and similar terms generally refer to ranges that include the identified value within a margin of 20%, 10%, or preferably 5%, and any values therebetween.

Aspects of this disclosure are directed to an apparatus for delivering fluid at elevated pressure and a corresponding method for delivering fluid at the elevated pressure using the apparatus. The apparatus addresses the longstanding problem of achieving the accurate and reliable delivery of fluid at elevated pressure. The apparatus includes multiple interconnected components specifically designed to deliver a metered volume of fluid in a controlled way during each operating cycle, while maintaining the fluid pressure inside the pressure vessel within predetermined limits. The apparatus is configured to monitor the pressure of the fluid within the pressure vessel at each instant and use the monitored pressure as feedback to control the operation of a pump.

Referring to FIG. 1, a schematic hydraulic circuit diagram of an apparatus 100 for delivering fluid at elevated pressure is illustrated, according to certain embodiments. The apparatus 100 includes a pressure vessel 102 configured to store pressurized air and a liquid. The apparatus 100 further includes a piston assembly 103 including a first piston 104 movable within a first cylinder 106 and a second piston 108 movable within a second cylinder 110. The first piston 104 and the second piston 108 are mechanically connected via a common shaft 109 such that movement of the first piston 104 in one direction causes a corresponding displacement of the second piston 108 in the same direction. The first piston 104 is provided with a piston head area that is larger than a piston head area of the second piston 108. The piston head area is defined as a surface area of a top face of the piston, which is oriented perpendicular to an axis of motion of the piston, and is exposed to fluid pressure within the cylinder.

The apparatus 100 includes a control valve 112 configured to selectively connect the pressure vessel 102 to the first cylinder 106 to regulate the flow of liquid from the pressure vessel 102 to the first cylinder 106, thereby enabling precise control over the pressure of the delivered liquid.

In one aspect, the control valve 112, which may be a three-way valve, is configured to selectively connect a liquid reservoir 120 to the first cylinder 106. The liquid reservoir 120 is maintained at atmospheric pressure. The control valve 112 may be configured to selectively direct pressurized liquid from the pressure vessel 102 to the first cylinder 106 and permit return flow of fluid from the first cylinder 106 to the liquid reservoir 120.

Further, by modulating position of the control valve 112, the apparatus 100 may selectively maintain desired pressure levels within the pressure vessel 102. The control valve 112 may be a solenoid-actuated valve or a proportional valve capable of dynamic flow regulation, without limiting the scope of the present disclosure to any specific valve configuration. The apparatus 100 further includes a delivery check valve 114 and a suction check valve 116 connected to the second cylinder 110 to regulate the flow of fluid into and out of the second cylinder 110 during operation. The suction check valve 116 permits the fluid to enter a chamber of the second cylinder 110 during a suction mode, while the delivery check valve 114 allows the pressurized fluid to exit the second cylinder 110 into a delivery conduit 132, thereby preventing the reverse flow of the liquid.

In an aspect, the delivery check valve 114 is a one-way valve to permit the flow of fluid from the second cylinder 110 to the delivery conduit 132 during the delivery mode.

In an aspect, the suction check valve 116 is a one-way valve to permit the flow of fluid from the liquid reservoir 121 into the second cylinder 110 during the suction mode.

Further, a pump 118 is provided to draw the liquid from the liquid reservoir 120 and deliver the liquid through a one-way valve 122 to the pressure vessel 102, which stores the liquid under a predetermined pressure. In an embodiment, the one-way valve 122 permits the flow of liquid only in the direction from the pump 118 to the pressure vessel 102, thereby preventing the reverse flow of liquid.

In an exemplary embodiment, the pump 118 is a centrifugal pump configured to circulate liquid, such as water, between the liquid reservoir 120, the pressure vessel 102, and the first cylinder 106 in a closed loop. The closed loop includes the liquid reservoir 120 for the storage of the liquid, the pressure vessel 102 that maintains the pressure of the liquid and for storing the pressurized liquid, and the first cylinder 106 for utilizing the pressurized liquid to generate a linear motion of the first piston 104 and the second piston 108. The pump 118 draws the liquid from the liquid reservoir 120, pressurizes the liquid via the pressure vessel 102, and delivers the pressurized liquid to the first cylinder 106. After actuation, the liquid returns to the liquid reservoir 120, completing the loop.

In the present configuration, the apparatus 100 includes a return biasing member 124 coupled to both the first piston 104 and the second piston 108 to facilitate the return movement of the first and second pistons 104, 108 upon completion of a delivery mode. Further, an adjustable stroke stopper 126 is associated with the piston assembly 103. The adjustable stroke stopper 126 is adjustable to limit a range of movement of the first piston 104 and the second piston 108 to control a metered volume of the fluid delivered from the fluid reservoir 121 during each operational cycle.

Figure 2:
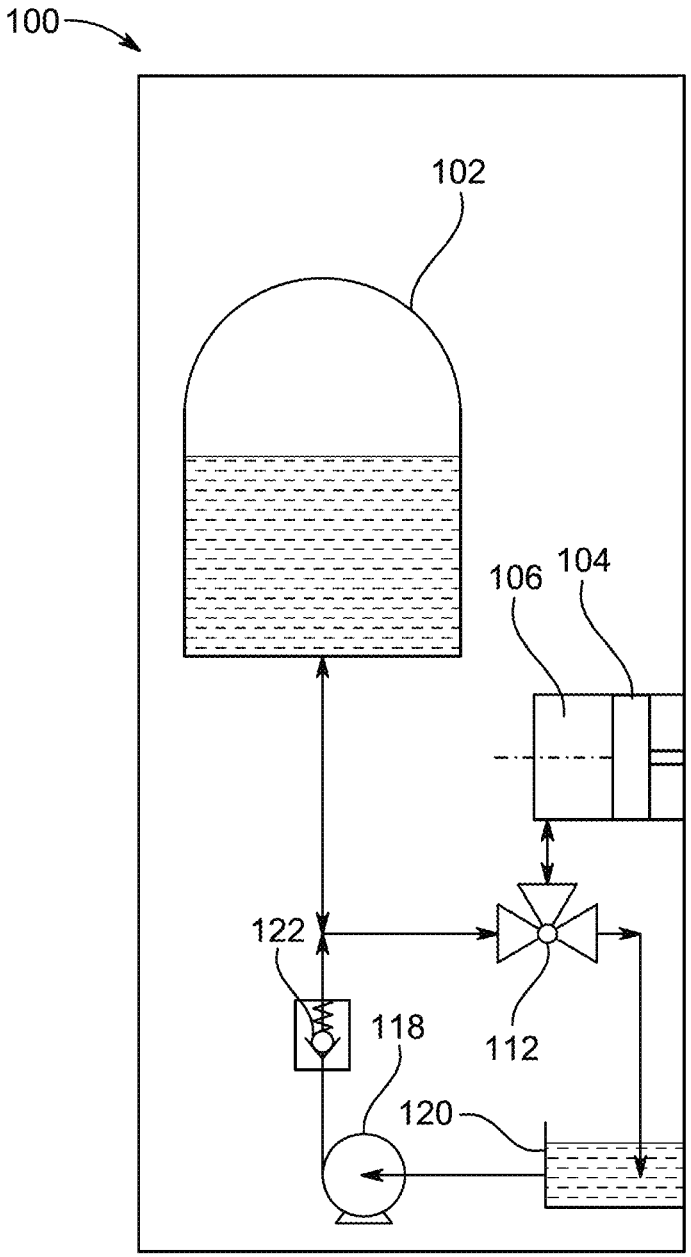
FIG. 2 is a portion of the schematic hydraulic circuit diagram of the apparatus showing the closed loop of a circuit including the pressure vessel, the first cylinder, and the liquid reservoir, according to certain embodiments.

Referring to FIG. 2, a portion of the schematic hydraulic circuit diagram of the apparatus 100 of FIG. 1 showing the closed loop of a circuit including the pressure vessel 102, the first cylinder 106, and the liquid reservoir 120 is illustrated, according to certain embodiments. The pump 118 (which may be a centrifugal pump) draws liquid from the liquid reservoir 120 and delivers the liquid into the pressure vessel 102 via the one-way valve 122. The one-way valve 122 permits unidirectional flow of the fluid into the pressure vessel 102, thereby preventing reverse flow and ensuring efficient compression of the trapped volume of air within the pressure vessel 102. As the liquid enters the pressure vessel 102, the pressure vessel 102 compresses the trapped volume of air sealed within the pressure vessel 102. The compression of the trapped volume of air increases the internal air pressure of the pressure vessel 102, thereby elevating the pressure of the stored liquid to the desired operating level or within predetermined pressure limits.

Figure 3:
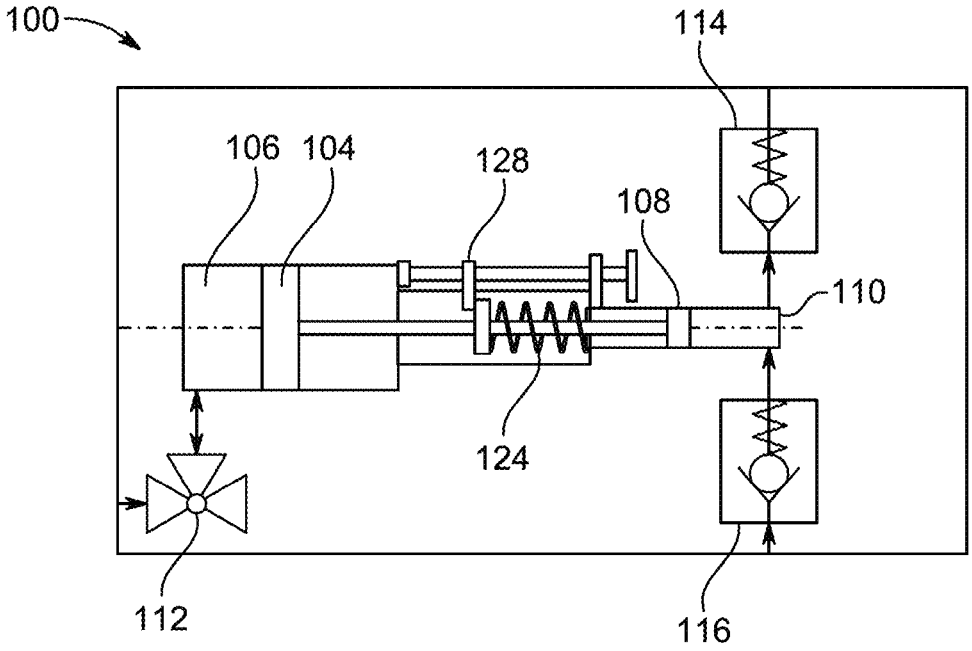
FIG. 3 is a portion of the schematic hydraulic circuit diagram illustrating the piston assembly and associated valves such as the suction check valve, the delivery check valve, and the control valve, according to certain embodiments.

Referring to FIG. 3, a portion of the schematic hydraulic circuit diagram of FIG. 1 illustrating the piston assembly 103 and associated valves such as the suction check valve 116, the delivery check valve 114, and the control valve 112 is shown, according to certain embodiments. The operation of the apparatus 100 includes a repeating cycle of the delivery mode and the suction mode, thereby enabling continuous and metered delivery of the fluid. In the delivery mode, the control valve 112 is actuated to connect pressure vessel 102 with the first cylinder 106. The pressurized liquid from the pressure vessel 102 is introduced into the first cylinder 106 acting on the first piston 104. The pressure applied on the first piston 104 causes pistons 104 and 108 to move in a first direction. The piston assembly 103 is arranged such that the movement of the first piston 104 in the first direction simultaneously moves the second piston 108 in the corresponding direction. As the second piston 108 moves within the second cylinder 110, the second piston 108 displaces the fluid contained therein (which was previously taken from the fluid reservoir 121), moving the fluid through the delivery check valve 114. The fluid is thus discharged at an elevated pressure. During delivery mode, the suction check valve 116 may remain closed, preventing backflow and ensuring that the displaced volume of liquid is delivered to the delivery conduit 132.

The pressure achieved is determined by a ratio of the piston head area of the first piston 104 to the piston head area of the second piston 108. The pressure achieved may be determined by the equation:

$$P_a \times A_f = P_d \times A_s$$

where:

$P_a$ is the pressure of the liquid acting on the first piston 104 within the first cylinder 106, $A_f$ is the piston head area of the first piston 104, $P_d$ is the pressure of the fluid delivered from the second cylinder 110, $A_s$ is the piston head area of the second piston 108, Upon completion of the delivery mode, the control valve 112 connects the first cylinder 106 to the liquid reservoir 120, thereby interrupting the connection between the pressure vessel 102 and the first cylinder 106, allowing the pressure in the first cylinder 106 to drop. As the pressure drops, the pistons (104 and 108) returns to their initial position. Since the first and second pistons 104, 108 are connected through the common shaft 109, an axial force generated by a spring action 124 results in axial displacement of both the pistons in a coordinated manner during the suction mode.

More specifically, the higher delivery pressure opens the delivery check valve 114 and closes the suction check valve 116, forcing the fluid inside the second cylinder 110 to flow to the delivery conduit 132 having lower pressure than the delivery pressure line. After the piston reaches the end of the stroke, the delivery dose will end, with the dose amount being metered by the distance where the adjustable stop member 128 stopped the pistons. The position of the adjustable stop member 128 may be controlled using a thread control screw 130. Another facility used may include controlling the period of actuating the control valve 112, which controls the timing of each stroke. After each period, a signal may be sent to the control valve 112 to switch to a different mode (e.g. from mode a to mode b), which connects the second cylinder 106 to the liquid reservoir 120. Mode b releases the pressure at the larger piston end to the atmospheric pressure, which leads to closing of the delivery check valve 114 and activation of the return biasing member 124 or suction spring to drive the pistons back and lower the pressure inside the smaller piston cylinder room. This causes the suction check valve 116 to open and the fluid to be sucked inside the room of the second cylinder 110 until the piston reaches the adjustable stop member 128 and stops. At the stop position, a signal can be sent to the control valve 112 to movechange modes to mode a, which connects the pressurized liquid inside the pressure vessel 102 to the available room of the first cylinder 106, and the delivery stroke is repeated.

In embodiments, the return biasing member 124 can be configured to facilitate the movement of the first piston 104 and the second piston 108 in the second direction opposite to the first direction, typically opposite to the fluid delivery direction during the suction mode. The return biasing member 124 ensures that the first piston 104 and the second piston 108 return to their respective starting positions or within the range defined by the adjustable stroke stopper 126, thereby preparing the apparatus 100 for the next delivery mode.

In one embodiment, the return biasing member 124 includes a spring, which provides a consistent restoring force to the piston assembly 103. The spring-based configuration allows for passive resetting of the pistons without requiring additional actuation and further contributing to the efficiency and reliability of the fluid delivery mechanism. The spring may be a helical compression spring, a torsion spring, a pneumatic spring, or any suitable elastic or energy storing component capable of providing the restoring force to return the first and second pistons 104, 108 to their initial positions.

In one embodiment, the adjustable stroke stopper 126 includes an adjustable stop member 128 and a threaded control screw 130 associated with the piston assembly 103 and configured to selectively limit the range of motion of both the first piston 104 and the second piston 108. More particularly, by constraining the stroke length of the piston assembly 103, the apparatus 100 may regulate the volume of fluid dispensed during each operational cycle. The threaded control screw 130 may be manually or automatically adjusted to vary the stroke length of the piston assembly 103. This adjustability enables controlled, metered delivery of fluid tailored to specific application requirements, enhancing the versatility and accuracy of the apparatus 100.

Figure 4:
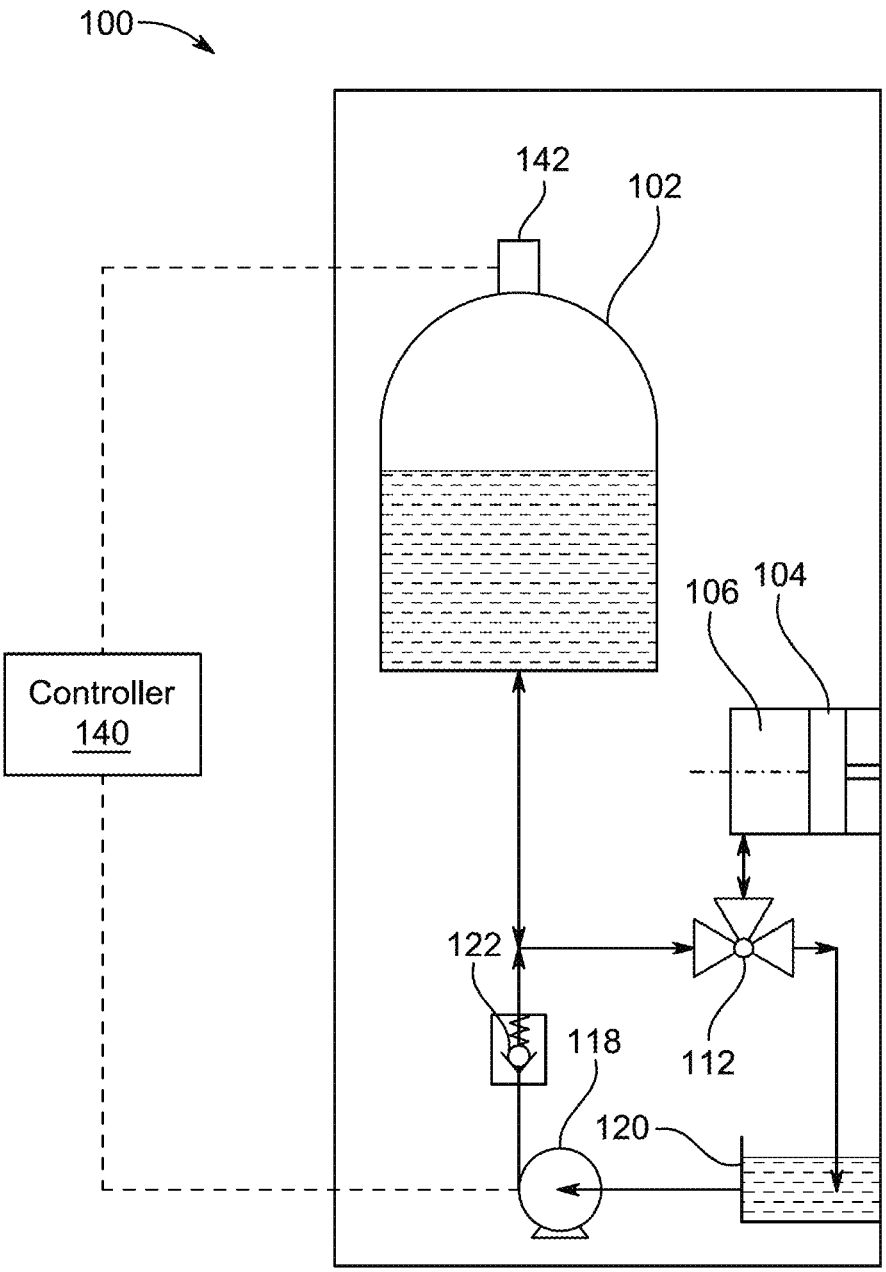
FIG. 4 is a schematic block diagram of a controller and a pressure sensor of the apparatus for delivering the fluid at the elevated pressure, according to certain embodiments.

Referring to FIG. 4, a schematic block diagram of a controller 140 and a pressure sensor 142 of the apparatus 100 for delivering the fluid at the elevated pressure is illustrated, according to certain embodiments. The apparatus 100 includes the pressure sensor 142 associated with the pressure vessel 102 configured to monitor pressure inside the pressure vessel 102. The pressure sensor 142 may monitor the pressure of the liquid and generate a signal proportional to the instantaneous pressure of the liquid within the pressure vessel 102. Further, the controller 140 may be configured to receive the signals from the pressure sensor 142 and to control operations of the pump 118 to maintain the pressure inside the pressure vessel 102 within predetermined limits based on the feedback received from the pressure sensor 142.

In an embodiment, the pressure sensor 142 continuously measures the pressure and may provide real-time feedback to the controller 140, ensuring that the pressure within the pressure vessel 102 remains within predefined operational limits, thereby maintaining the apparatus 100 safety and performance.

The controller 140 may activate the pump 118 when the sensed pressure of the fluid falls below the predetermined lower limit and deactivate the pump 118 when the sensed pressure reaches the predetermined upper limit. The feedback-based closed loop ensures efficient energy usage and consistent pressure of the delivered liquid. Once the desired pressure is achieved, the pressurized liquid is directed from the pressure vessel 102 to the first cylinder 106 through the control valve 112.

In one embodiment, the controller 140 may be configured to operate the control valve 112 based on the pressure data received from the pressure sensor 142. The controller 140 may generate signals to actuate the control valve 112, thereby selectively connecting the pressure vessel 102 to the first cylinder 106 during the delivery mode and connecting the first cylinder 106 to the liquid reservoir 120 during the suction mode.

In an embodiment, the control valve 112 is a three-way valve actuated according to a timed sequence to switch the apparatus 100 between the delivery mode and the suction mode based on a control logic, enabling continuous cyclic operation of the piston assembly 103 for uninterrupted delivery of the fluid. The control logic is defined as the set of rules, conditions or instructions implemented in the controller 140 to determine the operation of the apparatus 100. The control logic may include timing sequences, pressure thresholds or feedback-based decision making that control when the pump 118 or the control valve 112 are actuated.

In an embodiment, the adjustable stroke stopper 126 may be motorized or electronically controlled, allowing real-time adjustment of the piston stroke length by the controller 140 for different operating conditions.

In an embodiment, the apparatus 100 may be configured to handle multiple types of liquids using the piston assembly 103. The controller 140 controls the operation of the apparatus 100, enabling flexible dosing in complex applications.

Figure 5:
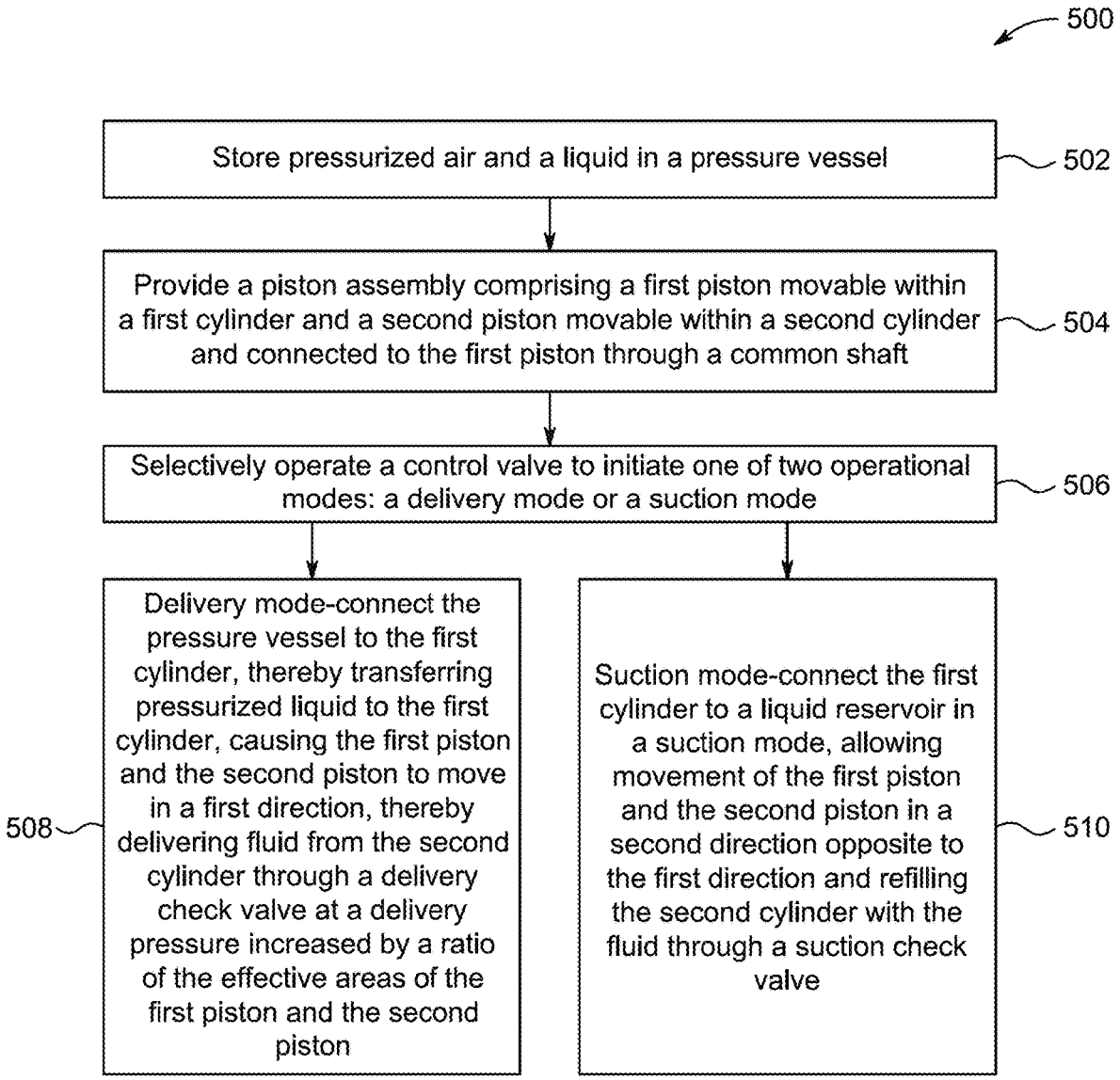
FIG. 5 is a flowchart of a method for delivering fluid at an elevated pressure, implemented by the apparatus for fluid delivery, according to certain embodiments.

Referring to FIG. 5, a schematic flowchart of a method 500 for delivering fluid at elevated pressure, implemented by the apparatus 100 for fluid delivery, is illustrated, according to certain embodiments. The method 500 illustrates the sequence of operations performed by the apparatus 100 to store, pressurize, and deliver fluid using the pressure vessel 102, the piston assembly 103, and the control valve 112. The method 500 ensures efficient pressure amplification and controlled fluid delivery through a closed-loop mechanism. The order in which the method 500 is described is not intended to be construed as a limitation, and any number of the described method steps can be combined in any order to implement the method 500. Additionally, individual steps may be removed or skipped from the method 500 without departing from the spirit and scope of the present disclosure.

At step 502, the method 500 begins by storing pressurized air and a liquid in the pressure vessel 102. As the liquid is introduced into the pressure vessel 102 containing the trapped volume of air, from the liquid reservoir 120 using the pump 118 through the one-way valve 122. the pressure vessel 102 compresses the air trapped within it, thereby increasing the internal pressure of the pressure vessel 102. Further, the method 500 includes monitoring the pressure inside the pressure vessel 102 using the pressure sensor 142. The pressure sensor 142 provides real-time pressure data to the controller 140, which is configured to analyze the readings and determine whether the pressure falls within the predefined limits. Based on this analysis, the controller 140 dynamically regulates the operation of the pump 118. In embodiments, the pump 118 is a centrifugal pump that charges the pressure vessel (which can be an air vessel) with pressurized feed water, which increases the pressure of the trapped air to the a predetermined operating pressure and is controlled by a pressure sensor that controls the pump by on/off signals at certain two pressure levels around the required operating pressure value.

At step 504, the method 500 includes providing the piston assembly 103, which includes the first piston 104 movable within the first cylinder 106 and the second piston 108 movable within the second cylinder 110 and connected to the first piston 104 through the common shaft 109. The first piston 104 includes a piston head area which is larger than the piston head area of the second piston 108.

At step 506, the method 500 includes selectively operating the control valve 112 to initiate one of two operational modes: the delivery mode or the suction mode. The control valve 112 includes actuating the three-way valve according to the timed sequence to switch between the delivery mode and the suction mode.

At step 508, the method 500 includes selectively operating the control valve 112 to connect the pressure vessel 102 to the first cylinder 106 in the delivery mode, thereby transferring pressurized liquid to the first cylinder 106, causing the first piston 104 and the second piston 108 to move in the first direction, thereby delivering fluid from the second cylinder 110 through the delivery check valve 114 at the delivery pressure increased by the ratio of effective areas of the first piston 104 and the second piston 108.

The incoming fluid exerts a force on the first piston 104, causing both pistons 104 and 108 to move in the first direction, thereby displacing the first piston 104 within the first cylinder 106 and the second piston 108 within the second cylinder 110. Further, the method 500 includes delivering fluid from the second cylinder 110 through the delivery check valve 114 to the delivery conduit 132. The pressure amplification is based on the ratio of the piston head areas of the first piston 104 and second piston 108. The dual-piston configuration enables high-pressure fluid delivery using relatively lower input pressure.

At step 510, the method 500 includes selectively operating the control valve 112 to connect the first cylinder 106 to the liquid reservoir 120 in the suction mode, allowing movement of the first piston 104 and the second piston 108 in the second direction opposite to the first direction and refilling the second cylinder 110 with the fluid through the suction check valve 116.

In some embodiments, the method 500 includes switching the control valve 112 to the suction mode. In the suction mode, the control valve 112 disconnects the pressure vessel 102 and instead connects the first cylinder 106 to the liquid reservoir 120. This allows both pistons 104 and 108 to move in the second direction opposite to the first direction, as a result of actuation by the return biasing member 124. During this suction mode, fluid is drawn into the second cylinder 110 through the suction check valve 116, thereby refilling the second cylinder 110 for the next delivery mode.

Further the method 500 includes adjusting the adjustable stroke stopper 126 associated with the piston assembly 103 to limit the range of movement of the first piston 104 and the second piston 108 to control delivery of a metered volume of the fluid during each cycle.

Figure 6:
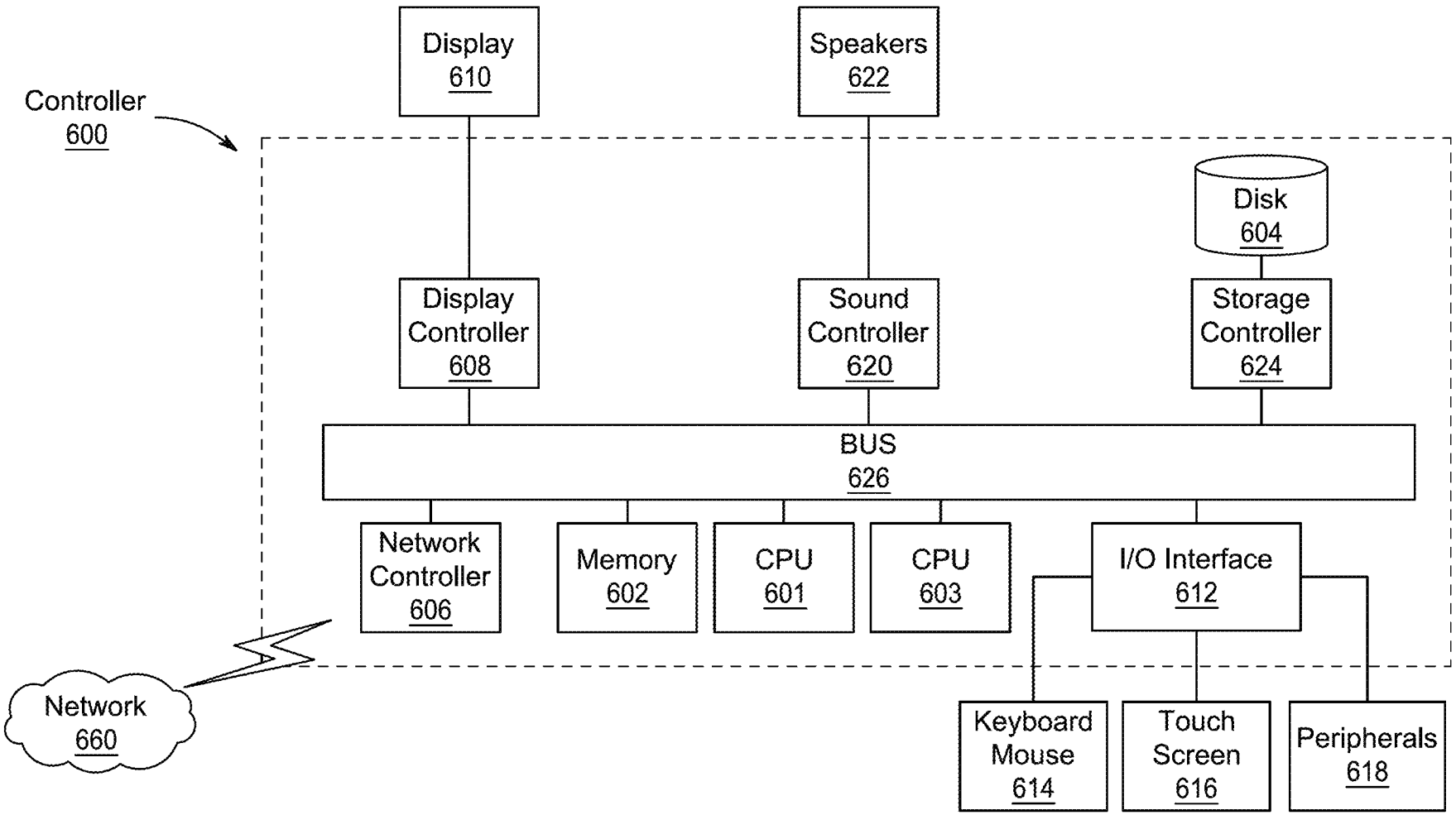
FIG. 6 is an illustration of a non-limiting example of details of computing hardware used in the apparatus, according to certain embodiments.

Next, further details of the hardware description of the computing environment according to exemplary embodiments is described with reference to FIG. 6. Referring to FIG. 6, illustrated is a schematic representation of a computing environment configured to control the apparatus 100 for fluid delivery at elevated pressure as described in FIG. 1. The controller 600 is representative of the controller 140 of the apparatus 100 of FIG. 1 and is implemented as a computing device configured to receive pressure signals from the pressure sensor 142 associated with the pressure vessel 102. The controller 600 includes a CPU 601 which performs the processes described above/below. The process data and instructions may be stored in memory 602. These processes and instructions may also be stored on a storage medium disk 604 such as a hard drive (HDD or SSD) or portable storage medium or may be stored remotely.

Further, the claims are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computing device communicates, such as a server or computer.

Further, the claims may be provided as a utility application, background daemon, or component of an operating system, or combination thereof, executing in conjunction with CPU 601, 603 and an operating system such as Microsoft Windows 7, Microsoft Windows 10, Microsoft Windows 11, UNIX, Solaris, LINUX, Apple MAC-OS and other systems known to those skilled in the art.

The hardware elements in order to achieve the computing device may be realized by various circuitry elements, known to those skilled in the art. For example, CPU 601 or CPU 603 may be a Xenon or Core processor from Intel of America or an Opteron processor from AMD of America, or may be other processor types that would be recognized by one of ordinary skill in the art. Alternatively, the CPU 601, 603 may be implemented on an FPGA, ASIC, PLD or using discrete logic circuits, as one of ordinary skill in the art would recognize. Further, CPU 601, 603 may be implemented as multiple processors cooperatively working in parallel to perform the instructions of the inventive processes described above.

The computing device in FIG. 6 also includes a network controller 606, such as an Intel Ethernet PRO network interface card from Intel Corporation of America, for interfacing with network 660. As can be appreciated, the network 660 can be a public network, such as the Internet, or a private network such as an LAN or WAN network, or any combination thereof and can also include PSTN or ISDN subnetworks. The network 660 can also be wired, such as an Ethernet network, or can be wireless such as a cellular network including EDGE, 3G, 4G and 5G wireless cellular systems. The wireless network can also be WiFi, Bluetooth, or any other wireless form of communication that is known.

The computing device further includes a display controller 608, such as a NVIDIA GeForce GTX or Quadro graphics adaptor from NVIDIA Corporation of America for interfacing with display 610, such as a Hewlett Packard HPL2445w LCD monitor. A general purpose I/O interface 612 interfaces with a keyboard and/or mouse 614 as well as a touch screen panel 616 on or separate from display 610. General purpose I/O interface also connects to a variety of peripherals 518 including printers and scanners, such as an OfficeJet or DeskJet from Hewlett Packard.

A sound controller 620 is also provided in the computing device such as Sound Blaster X-Fi Titanium from Creative, to interface with speakers/microphone 622 thereby providing sounds and/or music.

The general-purpose storage controller 624 connects the storage medium disk 604 with communication bus 626, which may be an ISA, EISA, VESA, PCI, or similar, for interconnecting all of the components of the computing device. A description of the general features and functionality of the display 610, keyboard and/or mouse 614, as well as the display controller 608, storage controller 624, network controller 606, sound controller 620, and general purpose I/O interface 612 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset, as shown on FIG. 7.

Figure 7:
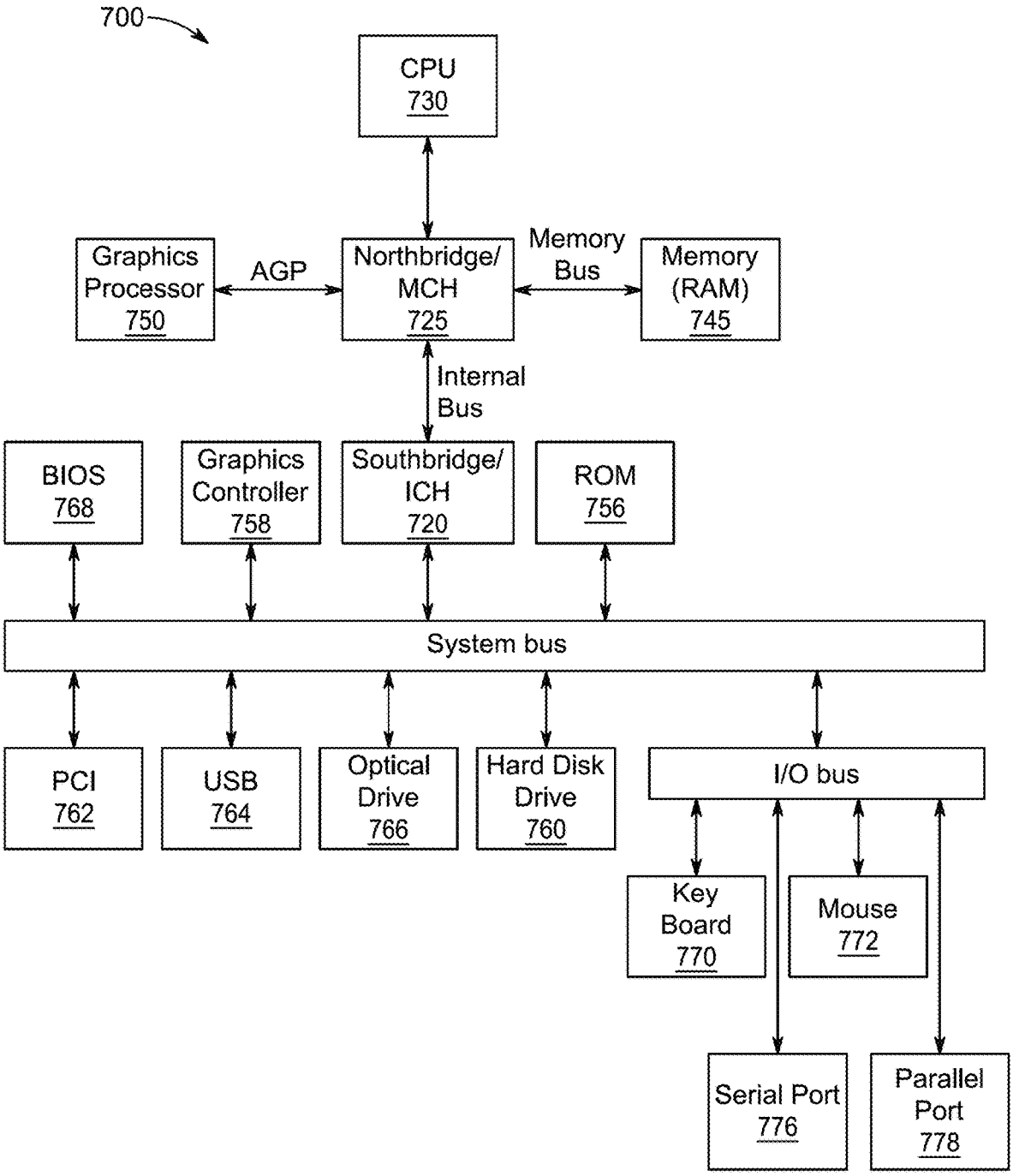
FIG. 7 is an exemplary schematic diagram of a data processing system used within the apparatus, according to certain embodiments.

FIG. 7 shows a schematic diagram of a data processing system, according to certain embodiments, for performing the functions of the exemplary embodiments. The data processing system is an example of a computer in which code or instructions implementing the processes of the illustrative embodiments may be located.

In FIG. 7, data processing system 700 employs a hub architecture including a north bridge and memory controller hub (NB/MCH) 725 and a south bridge and input/output (I/O) controller hub (SB/ICH) 720. The central processing unit (CPU) 730 is connected to NB/MCH 725. The NB/MCH 725 also connects to the memory 745 via a memory bus and connects to the graphics processor 750 via an accelerated graphics port (AGP). The NB/MCH 725 also connects to the SB/ICH 720 via an internal bus (e.g., a unified media interface or a direct media interface). The CPU Processing unit 730 may contain one or more processors and even may be implemented using one or more heterogeneous processor systems.

Figure 8:
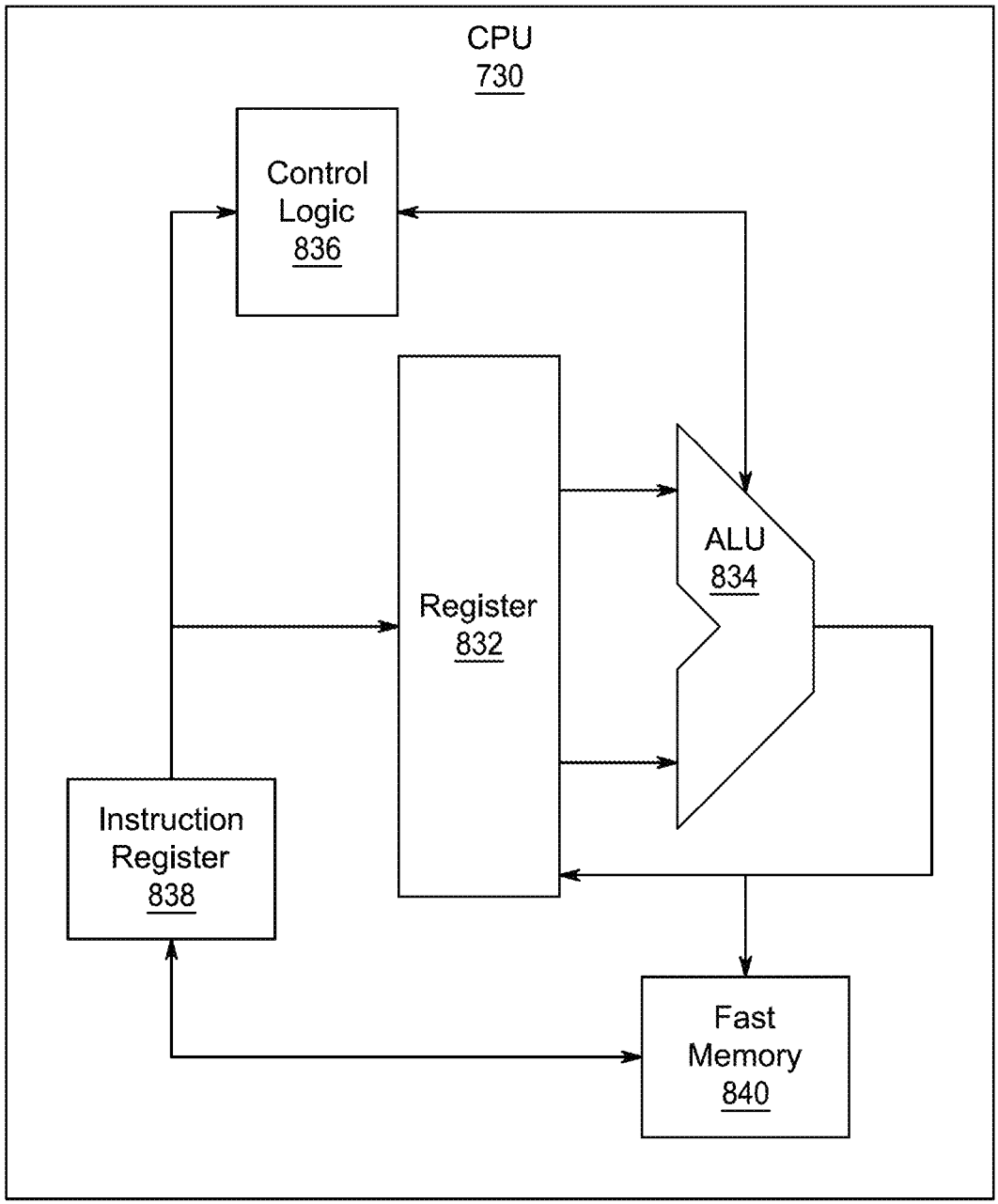
FIG. 8 is an exemplary schematic diagram of a processor used with a controller of the apparatus, according to certain embodiments.

For example, FIG. 8 shows one implementation of CPU 730. In one implementation, the instruction register 838 retrieves instructions from the fast memory 840. At least part of these instructions are fetched from the instruction register 838 by the control logic 836 and interpreted according to the instruction set architecture of the CPU 730. Part of the instructions can also be directed to the register 832. In one implementation the instructions are decoded according to a hardwired method, and in another implementation the instructions are decoded according to a microprogram that translates instructions into sets of CPU configuration signals that are applied sequentially over multiple clock pulses. After fetching and decoding the instructions, the instructions are executed using the arithmetic logic unit (ALU) 834 that loads values from the register 832 and performs logical and mathematical operations on the loaded values according to the instructions. The results from these operations can be feedback into the register and/or stored in the fast memory 840. According to certain implementations, the instruction set architecture of the CPU 730 can use a reduced instruction set architecture, a complex instruction set architecture, a vector processor architecture, a very large instruction word architecture. Furthermore, the CPU 730 can be based on the Von Neuman model or the Harvard model. The CPU 730 can be a digital signal processor, an FPGA, an ASIC, a PLA, a PLD, or a CPLD. Further, the CPU 730 can be an x86 processor by Intel or by AMD; an ARM processor, a Power architecture processor by, e.g., IBM; a SPARC architecture processor by Sun Microsystems or by Oracle; or other known CPU architecture.

Referring again to FIG. 7, the data processing system 700 can include that the SB/ICH 720 is coupled through a system bus to an I/O Bus, a read only memory (ROM) 756, universal serial bus (USB) port 764, a flash binary input/output system (BIOS) 768, and a graphics controller 758. PCI/PCIe devices can also be coupled to SB/ICH 720 through a PCI bus 762.

The PCI devices may include, for example, Ethernet adapters, add-in cards, and PC cards for notebook computers. The Hard disk drive 760 and Optical Drive 766 can use, for example, an integrated drive electronics (IDE) or serial advanced technology attachment (SATA) interface. In one implementation the I/O bus can include a super I/O (SIO) device.

Further, the hard disk drive (HDD) 760 and optical drive 766 can also be coupled to the SB/ICH 720 through a system bus. In one implementation, a keyboard 770, a mouse 772, a parallel port 778, and a serial port 776 can be connected to the system bus through the I/O bus. Other peripherals and devices that can be connected to the SB/ICH 720 using a mass storage controller such as SATA or PATA, an Ethernet port, an ISA bus, a LPC bridge, SMBus, a DMA controller, and an Audio Codec.

Moreover, the present disclosure is not limited to the specific circuit elements described herein, nor is the present disclosure limited to the specific sizing and classification of these elements. For example, the skilled artisan will appreciate that the circuitry described herein may be adapted based on changes on battery sizing and chemistry or based on the requirements of the intended back-up load to be powered.

Figure 9:
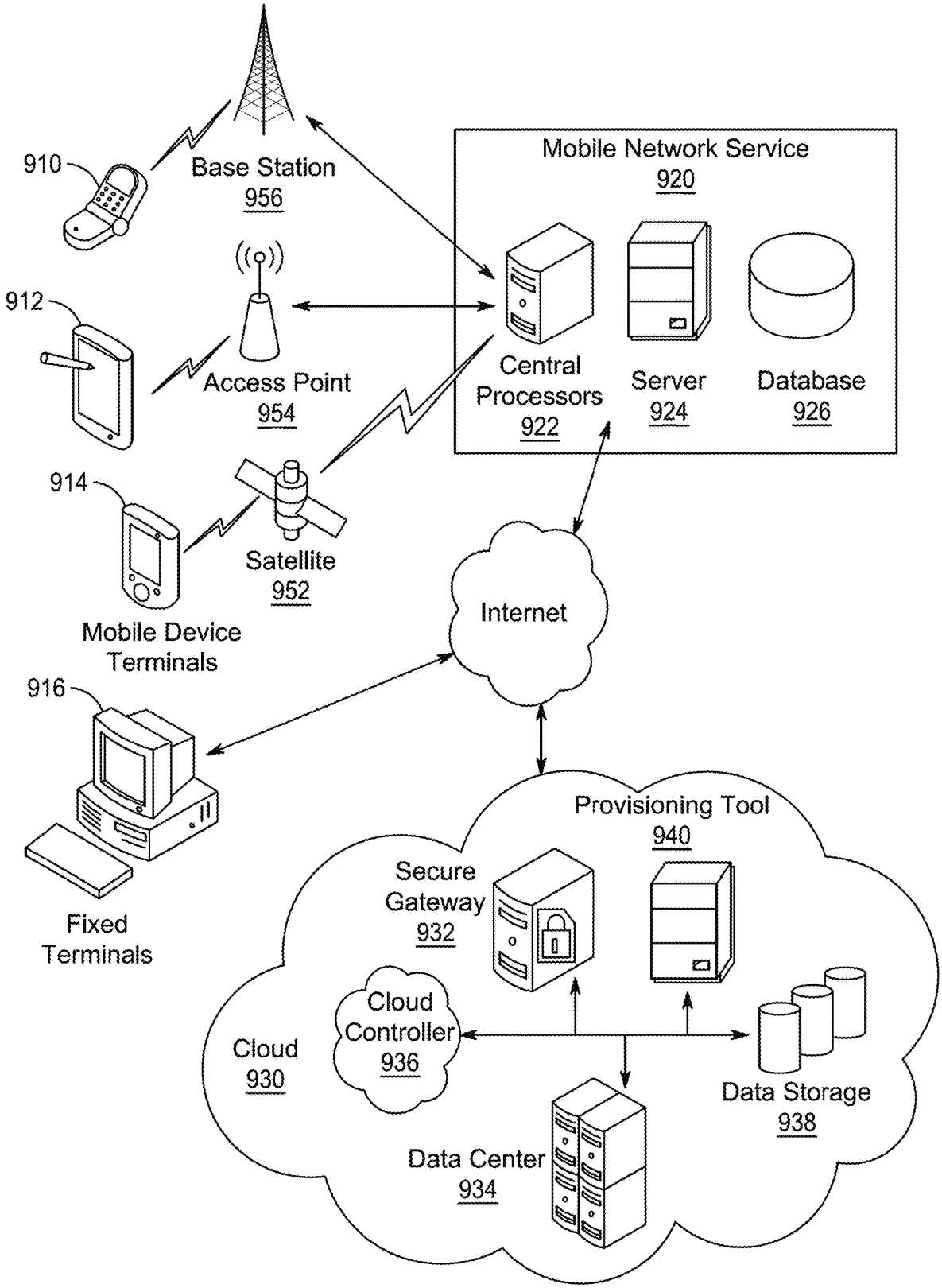
FIG. 9 is an illustration of a non-limiting example of distributed components which may share processing with a controller, according to certain embodiments.

The functions and features described herein may also be executed by various distributed components of a system. For example, one or more processors may execute these system functions, wherein the processors are distributed across multiple components communicating in a network. The distributed components may include one or more client and server machines, such as cloud 930 including a cloud controller 936, a secure gateway 932, a data center 934, data storage 938 and a provisioning tool 940, and mobile network services 920 including central processors 922, a server 924 and a database 926, which may share processing, as shown by FIG. 9, in addition to various human interface and communication devices (e.g., display monitors 916, smart phones 910, tablets 912, personal digital assistants (PDAs) 914). The network may be a private network, such as a LAN, satellite 952 or WAN 954, or be a public network, may such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein.

The disclosed apparatus is useful in applications requiring accurate and repeatable metered delivery of fluids at elevated pressure. Further, by maintaining the delivery pressure within predetermined limits and minimizing component wear, the apparatus 100 achieves extended service life and enhanced reliability.

Numerous modifications and variations of the present disclosure are possible in light of the above teachings. It is therefore to be understood that within the scope of the appended claims, the invention may be practiced otherwise than as specifically described herein.

The invention claimed is:

1. An apparatus for delivering metered fluid at elevated pressure, comprising:

a first fluid circuit associated with a first liquid, the first fluid circuit comprising:

a first liquid reservoir, configured to store the first liquid, a pump, configured to draw the first liquid from the first liquid reservoir, a pressure vessel, configured to contain a trapped volume of air and use the trapped volume of air to pressurize the first liquid within the pressure vessel, a one-way valve, fluidly connecting the pump to the pressure vessel and configured to permit flow of the first liquid from the pump to the pressure vessel, a first cylinder, and a control valve, fluidly coupled to the pressure vessel, the first liquid reservoir, and the first cylinder, the control valve being configured to: (1) in a delivery mode, connect the pressure vessel to the first cylinder to deliver the first liquid pressurized by the pressure vessel to the first cylinder, and (2) in a suction mode, connect the first cylinder to the first liquid reservoir to permit return flow of the first liquid from the first cylinder to the first liquid reservoir;

a second fluid circuit associated with a second liquid, the second fluid circuit comprising:

a second liquid reservoir, configured to store the second liquid, a second cylinder, a suction check valve, fluidly connecting the second liquid reservoir to the second cylinder and configured to permit flow of the second liquid from the second liquid reservoir into the second cylinder during the suction mode, a delivery conduit, and a delivery check valve, fluidly connecting the second cylinder to the delivery conduit and configured to permit metered flow of the second liquid from the second cylinder to the delivery conduit during the delivery mode; and a piston assembly comprising:

a first piston movable within the first cylinder, a second piston movable within the second cylinder, a common shaft mechanically coupling the first piston and the second piston such that movement of the first piston in a first direction during the delivery mode causes corresponding movement of the second piston in the first direction, an adjustable stroke stopper, configured to limit a range of movement of the first piston and the second piston to control a metered volume of the second liquid delivered during the delivery mode, and a return biasing member coupled to the first piston and the second piston and configured to move the first piston and the second piston in a second direction opposite to the first direction during the suction mode, wherein the first piston comprises a piston head area larger than a piston head area of the second piston, wherein the control valve is a three-way valve actuated according to a timed sequence to switch the apparatus between the delivery mode and the suction mode, wherein in the delivery mode the metered second liquid is delivered from the second cylinder through the delivery check valve to the delivery conduit at an elevated pressure corresponding to a pressure of the first liquid acting on the first piston multiplied by a ratio of the piston head area of the first piston to the piston head area of the second piston, and wherein in the suction mode, the second liquid is drawn from the second liquid reservoir through the suction check valve into the second cylinder.

2. The apparatus of claim 1 wherein the control valve comprises:

a solenoid-actuated valve, or a proportional valve.

3. The apparatus of claim 1, wherein the pump is a centrifugal pump configured to circulate the first liquid between the liquid reservoir, the pressure vessel and the first cylinder in a closed loop.

4. The apparatus of claim 1, further comprising:

a pressure sensor associated with the pressure vessel configured to monitor a pressure inside the pressure vessel.

5. The apparatus of claim 4, further comprising a controller configured to receive signals from the pressure sensor and to control operations of the pump to maintain the pressure inside the pressure vessel within predetermined limits.

6. The apparatus of claim 5, wherein the timed sequence is determined based on a control logic implemented in the controller to enable cyclic switching of the apparatus between the delivery mode and the suction mode.

7. The apparatus of claim 1, wherein the delivery check valve is a one-way valve.

8. The apparatus of claim 1, wherein the suction check valve is a one-way valve.

9. The apparatus of claim 1, wherein the adjustable stroke stopper further comprises an adjustable stop member and a threaded control screw.

10. The apparatus of claim 9, wherein the threaded control screw is automatically adjusted to vary a position of the adjustable stop member, the position of the adjustable stop member defining the range of movement of the first piston and the second piston to deliver metered fluid.

11. The apparatus of claim 9, wherein the threaded control screw is manually adjusted to vary a position of the adjustable stop member, the position of the adjustable stop member defining the range of movement of the first piston and the second piston to deliver metered fluid.

12. The apparatus of claim 1, wherein the return biasing member comprises:

a helical compression spring, or a pneumatic spring.

13. A method for delivering metered fluid at elevated pressure using an apparatus, comprising:

providing a first fluid circuit associated with a first liquid, the first fluid circuit comprising:

a first liquid reservoir, configured to store the first liquid, a pump, configured to draw the first liquid from the first liquid reservoir, a pressure vessel, configured to contain a trapped volume of air and use the trapped volume of air to pressurize the first liquid within the pressure vessel, a one-way valve, fluidly connecting the pump to the pressure vessel and configured to permit flow of the first liquid from the pump to the pressure vessel, a first cylinder, and a control valve, fluidly coupled to the pressure vessel, the first liquid reservoir, and the first cylinder, the control valve being configured to: (1) in a delivery mode, connect the pressure vessel to the first cylinder to deliver the first liquid pressurized by the pressure vessel to the first cylinder, and (2) in a suction mode, connect the first cylinder to the first liquid reservoir to permit return flow of the first liquid from the first cylinder to the first liquid reservoir;

providing a second fluid circuit associated with a second liquid, the second fluid circuit comprising:

a second liquid reservoir, configured to store the second liquid, a second cylinder, a suction check valve, fluidly connecting the second liquid reservoir to the second cylinder and configured to permit flow of the second liquid from the second liquid reservoir into the second cylinder during the suction mode, a delivery conduit, and a delivery check valve, fluidly connecting the second cylinder to the delivery conduit and configured to permit metered flow of the second liquid from the second cylinder to the delivery conduit during the delivery mode; and providing a piston assembly comprising:

a first piston movable within the first cylinder, a second piston movable within the second cylinder, a common shaft mechanically coupling the first piston and the second piston such that movement of the first piston in a first direction during the delivery mode causes corresponding movement of the second piston in the first direction, an adjustable stroke stopper, configured to limit a range of movement of the first piston and the second piston to control a metered volume of the second liquid delivered during the delivery mode, and a return biasing member coupled to the first piston and the second piston and configured to move the first piston and the second piston in a second direction opposite to the first direction during the suction mode, wherein the first piston comprises a piston head area larger than a piston head area of the second piston, wherein the control valve is a three-way valve actuated according to a timed sequence to switch the apparatus between the delivery mode and the suction mode, wherein in the delivery mode, the metered second liquid is delivered from the second cylinder through the delivery check valve to the delivery conduit at an elevated pressure corresponding to a pressure of the first liquid acting on the first piston multiplied by a ratio of the piston head area of the first piston to the piston head area of the second piston, and wherein in the suction mode, the second liquid is drawn from the second liquid reservoir through the suction check valve into the second cylinder.

14. The method of claim 13 wherein the control valve comprises:

a solenoid-actuated valve, or a proportional valve.

15. The method of claim 3 wherein the pump is a centrifugal pump configured to circulate the first liquid between the liquid reservoir, the pressure vessel and the first cylinder in a closed loop.

16. The method of claim 13, further comprising:

providing a pressure sensor associated with the pressure vessel configured to monitor a pressure inside the pressure vessel.

17. The method of claim 16, further comprising:

providing a controller configured to receive signals from the pressure sensor and to control operations of the pump to maintain the pressure inside the pressure vessel within predetermined limits.

18. The method of claim 17, wherein the timed sequence is determined based on a control logic implemented in the controller to enable cyclic switching of the apparatus between the delivery mode and the suction mode.

19. The method of claim 13 wherein the adjustable stroke stopper further comprises an adjustable stop member and a threaded control screw.

20. The method of claim 19, wherein the threaded control screw is automatically or manually adjusted to vary a position of the adjustable stop member, the position of the adjustable stop member defining the range of movement of the first piston and the second piston to control the metered volume of the second cylinder, and the return biasing member comprises a helical compression spring or a pneumatic spring.

* * * * *